US005305177A

United States Patent [19]

Aoki et al.

[11] Patent Number: 5,305,177

[45] Date of Patent: Apr. 19, 1994

[54] CHARGING DEVICE AND IMAGE FORMING APPARATUS

[75] Inventors: Fumitaka Aoki, Tokyo; Yasushi Sato, Kawasaki; Norio Hashimoto, Tokyo; Tetsuo Saito, Sagamihara; Hirokazu Ikenoue, Inagi; Kenji Nagata, Tachikawa; Toshihiko Yamanaka, Kawasaki, all of Japan

[73] Assignee: Canon Kabushiki Kaisha, Tokyo, Japan

[21] Appl. No.: 786,557

[22] Filed: Nov. 1, 1991

[30] Foreign Application Priority Data

Nov. 2, 1990 [JP] Japan ..... 2-298418

[51] Int. Cl.[5] ..... G03G 15/00

[52] U.S. Cl. ..... 361/225; 355/219; 361/220

[58] Field of Search ..... 361/220, 221, 225, 229, 361/230, 235; 355/219

[56] References Cited

U.S. PATENT DOCUMENTS

| | | | |
|---|---|---|---|
| 4,727,453 | 2/1988 | Ewing | 361/225 |
| 4,851,960 | 7/1989 | Nakamura et al. | 361/225 |
| 5,144,368 | 9/1992 | Ohzeki et al. | 355/219 |
| 5,146,281 | 9/1992 | Kisu | 355/219 |
| 5,164,779 | 11/1992 | Araya et al. | 355/219 |

FOREIGN PATENT DOCUMENTS

| | | |
|---|---|---|
| 0280542 | 8/1988 | European Pat. Off. . |
| 0338546 | 10/1989 | European Pat. Off. . |
| 56-104351 | 8/1981 | Japan . |
| 57-178267 | 11/1982 | Japan . |
| 58-40566 | 3/1983 | Japan . |
| 58-139156 | 8/1983 | Japan . |
| 58-150975 | 9/1983 | Japan . |

*Primary Examiner*—Jeffrey A. Gaffin

*Attorney, Agent, or Firm*—Fitzpatrick, Cella, Harper & Scinto

[57] ABSTRACT

A charging device includes a charging member contactable to a member to be charged. A bias source includes an AC source and a DC source and is effective to apply a bias voltage to the charging member. The bias voltage is provided by a superposing a constant current controlled AC voltage and a constant voltage controlled DC voltage. When a DC voltage is applied between the charging member and the member to be charged, the following equation is satisfied.

|(applied voltage V)−(charge voltage $V_D$ of the member to be charged)| = |(charge starting voltage $V_{TH}$)|.

The charge starting voltage is a DC voltage at a level which the member to be charged starts charging when only a DC voltage is applied between the member to be charged and the charging member. When the above relationship is used in the AC voltage application, the charge voltage $V_D$ oscillates in the charge region with a center of DC voltage $V_{DC}$. Since the peak-to-peak voltage of the oscillating voltage required for uniform charging changes with ambient conditions, it is necessary to compensate for this change. The electric current supplied to the charging member by the oscillating component provided by the AC source is controlled to be constant. Since the charge potential of the member to be charged is determined by the DC voltage component, it is charged to a constant potential by supplying a constant DC voltage level. Therefore, the DC voltage source of the bias voltage effects a constant voltage control.

19 Claims, 9 Drawing Sheets

CHARGING DEVICE AND IMAGE FORMING APPARATUS

FIELD OF THE INVENTION AND RELATED ART

The present invention relates to a charging device and an image forming apparatus using the same, the charging device includes a charging member supplied with a voltage and contacted to a member to be charged to charge or discharge the member.

In an image forming apparatus, such as an electrophotographic apparatus (copying machine, laser beam printer), an electrostatic recording apparatus, electrode and a shield electrode enclosing the wire electrode, is widely used as a means for electrically charging a surface of an image bearing member such as a photosensitive member or a dielectric member (a member to be charged).

Corona discharge is effective for uniformly charging to a predetermined polarity the member to be charged (image bearing member or the like). However, it involves problems that a high voltage source is required, that the charging efficiency is low, that the structure and complicated with the result of high manufacturing cost and that a relatively large amount of ozone is produced by the corona discharging action.

An additional problem is that the discharging wire is susceptible to being contaminated and being broken.

On the contrary, a contact type charging means in which a charging member supplied with a voltage is contacted to the member to be charged is advantageous in that the voltage of the voltage source may be low, that the structure is simple without the possibility of breaking of a charging wire electrode and that the amount of the ozone production is very small. Therefor it is particularly noted as means replacing the corona discharger for charging the image bearing member such as the photosensitive member or the dielectric member or another member to be charged or discharged in the image forming apparatus (Japanese Laid-Open Patent Applications Nos. 178267/1982, 104351/1981, 40566/1983, 139156/1983, 150975/1983, for example).

U.S. Pat. No. 4,851,960 proposes a charging system in which a DC biased AC voltage is applied to the charging member to effect uniform charging operation.

FIG. 12 shows an example of such a charging system, wherein reference numeral 1 designates an electrophotographic photosensitive member (photosensitive drum) in an electrophotographic apparatus. It is the member to be charged and is rotated in a predetermined peripheral speed (process speed) in the direction indicated by an arrow. A charging member in the form of a charging roller 2 comprises a core metal 4 and an electrically conductive elastic layer 3 on the outer periphery of the core metal. The charging roller 2 is pressed to the photosensitive drum 1 by a pressing spring 7 to form a nip therebetween. A bias voltage source 6 functions to supply to the charging roller 2 with a voltage which is an oscillating voltage in the form of a DC biased AC voltage. The charging roller 2 is supplied with a voltage at the core metal 4 from the bias voltage source 6 through a contact spring 5. Then, the surface of the photosensitive drum 1 is charged to a polarity corresponding to the level of the DC component voltage.

Around the photosensitive drum 1, there are disposed in addition to the charging roller 2, exposure means, developing means, transfer means, cleaning means, or the like, which constitute image forming process means, so as to provide an image forming mechanism. However, these components are omitted from the Figure for simplicity.

The conductive elastic material 3 is coated with a material having a proper resistance or coated with plural layers having different electric resistances so that improper charging due to a defect such as a pinhole or a local defect in the photosensitive layer, created during manufacturing can be prevented. An intermediate resistance material in the charging roller is subject to ambient conditions, particularly humidity conditions. Under the low humidity, resistance increases, and in under high humidity conditions the resistance decreases.

Therefore, the impedance of the charging roller 2 changes with the result that the minimum required peak-to-peak voltage Vpp of the AC component changes. However, it has been found that the minimum AC current rather than the AC voltage, required for the uniform charging, through the charging roller is substantially constant irrespective of the ambient conditions, as shown in European Publication 0 338 546 A3.

Therefore, by effecting constant current control through the charging member by controlling the peak-to-peak voltage Vpp of the AC component, the variation in the resistance of the elastic member 3 due to changes in the ambient conditions can be automatically compensated. This system assures the lower limit, that is, the minimum required AC voltage because of the constant current control for the AC voltage.

However, it does not assure the upper limit of the peak-to-peak Vpp.

The following has been found by experiments and investigations performed by the inventors. As shown in FIG. 14, under low humidity conditions, the resistance of the elastic layer 3 of the charging member increases. Therefore, the impedance of the charging rollers increases, and the peak-to-peak voltage Vpp increases if the AC voltage is controlled by a constant current control. If the peak-to-peak voltage Vpp is too high, that is, beyond $V_{LEAK}$, the electric charge once deposited on the photosensitive drum 1 leaks with the result of local abnormal discharging. This results in fine lateral stripes on the output image in an image forming apparatus. Thus, the quality of the image is deteriorated.

Therefore, under low humidity conditions, the charging roller having the impedance a in FIG. 14 is usable, but the charging roller having the impedance b involves the liability that local abnormal discharging occurs due to the leakage, in consideration of the unavoidable variation in the AC current due to the tolerance of the bias voltage source. During manufacturing of the charging roller, the resistance of the roller so varies that the rollers having the impedances a and b in FIG. 14 are produced. If the rollers having the impedance b are rejected the productivity becomes low.

SUMMARY OF THE INVENTION

Accordingly, it is a principal object of the present invention to provide a charging device and an image forming apparatus the same wherein abnormal discharging due to charge leakage is prevented.

It is another object of the present invention to provide a charging device and an image forming apparatus using the same wherein image quality deterioration due to charge leakage is prevented.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 15:
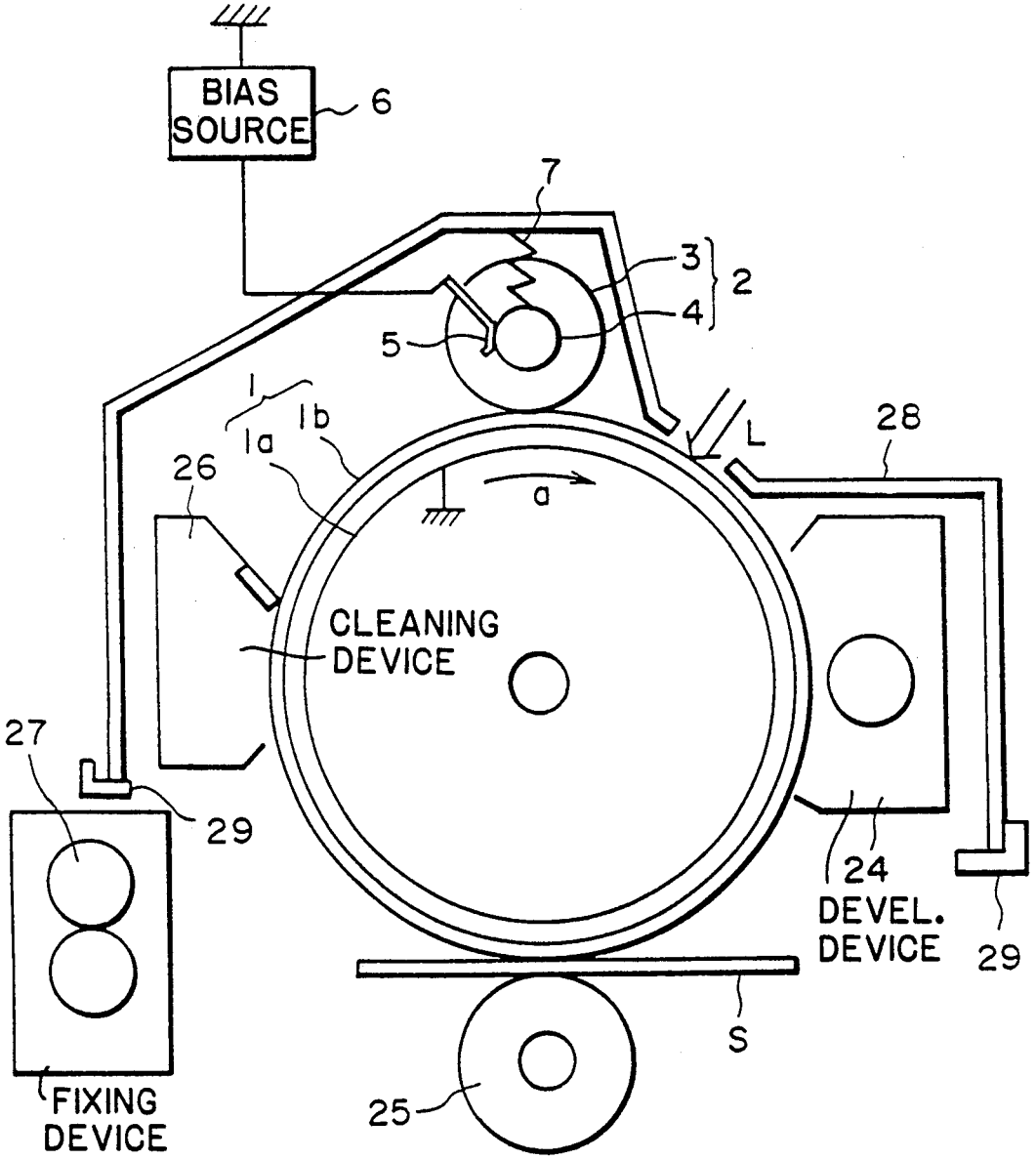
FIG. 15 is a sectional view of an image forming apparatus according to an embodiment of the present invention.

FIG. 15 is a sectional view of an image forming apparatus in which reference numeral 1 designates a member to be charged (photosensitive drum). The photosensitive drum 1 comprises a conductive base 1*a* formed of aluminum or the like and an OPC photosensitive layer 1*b* thereon. It is rotatable at a predetermined speed in a direction indicated by an arrow a.

A charging member in the form of a charging roller 2 is contacted to the surface of the photosensitive drum 1. The charging roller 2 comprises a core metal 4 and a conductive elastic layer 3 thereon. The charging roller 2 is pressed to the photosensitive drum 1 by a pressing spring 7 so as to form a nip.

A bias voltage source 6 functions to supply an oscillating voltage between the photosensitive drum 1 and the charging roller 2 through spring contacts 5, the applied voltage being in the form of a DC biased AC. The charging roller 2 is rotatable with the photosensitive drum 1. The photosensitive drum 1 is charged uniformly by the charging roller 2 and is exposed to image light L by exposure means in accordance with image information. In this embodiment, the exposure means includes an unshown laser beam scanner for producing a laser beam modulated in accordance with an electric signal representing the image information. The photosensitive drum 1 now having an electrostatic latent image formed by the image exposure is developed with toner by the developing device 24. The toner image is transferred from the photosensitive drum 1 onto the transfer sheet S by the transfer roller 25. To the transfer roller 25, an image transfer voltage is applied. The toner image is fixed on the transfer material S by the fixing device 27. On the other hand, the photosensitive drum 1, after the image transfer operation, is cleaned by a cleaning device so that the residual toner is removed therefrom by the cleaning device 26. Then, the photosensitive drum is prepared for the next image forming-operation.

As shown in FIG. 15 the photosensitive drum 1, the charging roller 2, the cleaning device 26 and the developing device 4 are supported in a process unit 28. The process unit 28 is detachably mountable to a main assembly of the image forming apparatus. The mounting and dismounting operation of the process unit 28 is effected by sliding it along the guide 29 in the image forming apparatus. The developing de 4 may be a separate member from the process unit 28. The process unit 28 may contain the photosensitive drum 1 (image bearing member) and at least the charging roller 2 (charging member).

Figure 1:
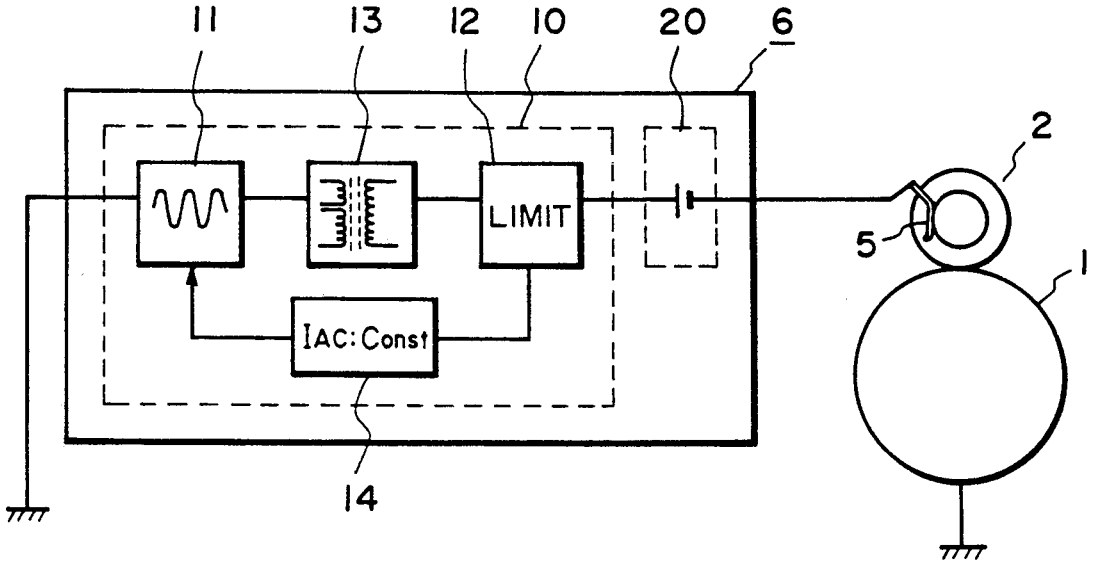
FIG. 1 is a block diagram of a control circuit of a charging device according to a first embodiment of the present invention.

FIG. 1 shows a charging device according to a first embodiment of the present invention, which is usable with the image forming apparatus shown in FIG. 15. The same reference numerals are assigned to the elements having the corresponding functions, and the detailed description thereof is omitted for simplicity. The bias source 6 comprises an AC source 10 and a DC source 20 and is effective to apply to a charging roller a bias voltage which is provided by superposing a constant current controlled AC voltage and a constant voltage controlled DC voltage. When a DC voltage is applied between the charging member and the member to be charged, the following equation is satisfied:

$$|(\text{applied voltage } V)-(\text{charge voltage } V_D \text{ of the member to be charged})| = |(\text{charge starting voltage } V_{TH})|$$

The charge starting voltage is, as shown in EPO280542 A2, is a DC voltage at which the charging of the member to be charged starts when only a DC voltage is applied between the member to be charged and the charging member.

Figure 13:
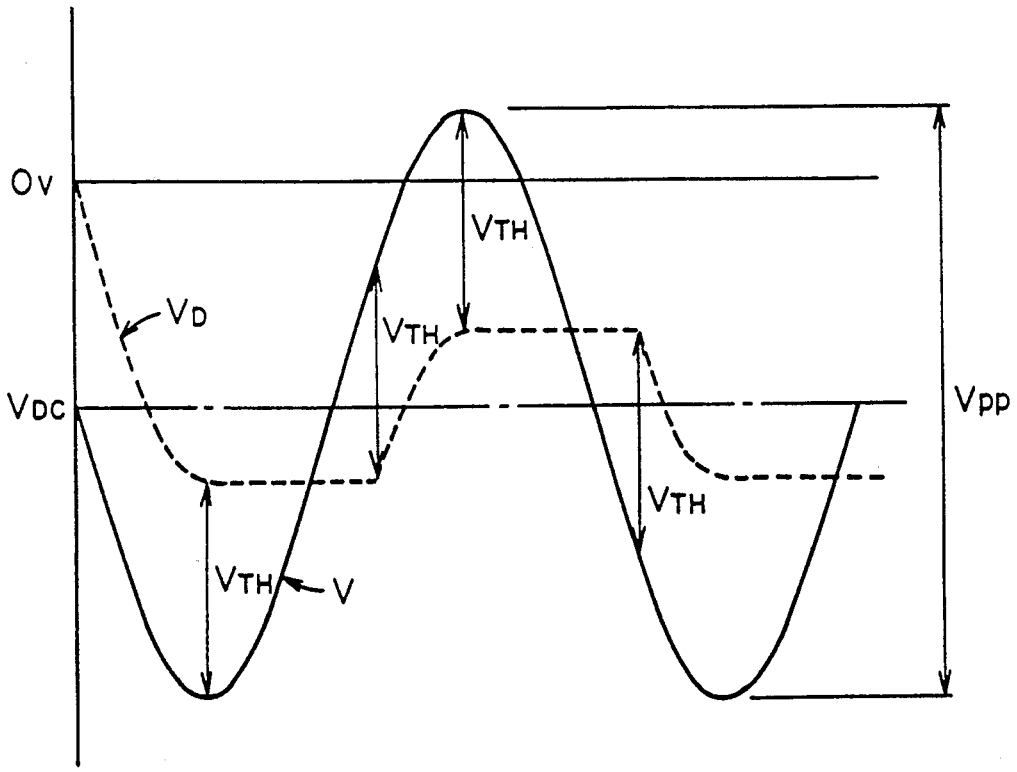
FIG. 13 PRIOR ART
FIGS. 13 and 14 show charging characteristics of an example of a contact type charging device.
Figure 14:
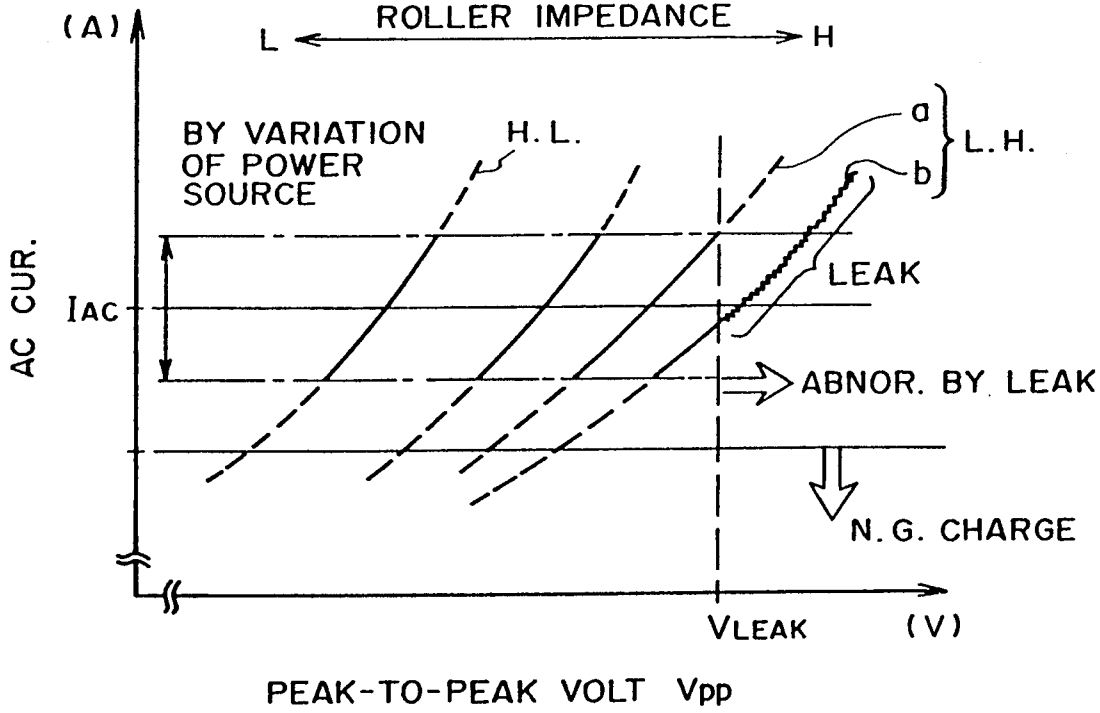
FIG. 14 PRIOR ART

When the above relation is used in the AC voltage application, the charge potential $V_D$ (broken line) oscillates in the charge region with a center of DC voltage $V_{DC}$, by the variation in the applied voltage (solid line), as shown in FIG. 13.

Here, the reverse charging process will be considered in which the charging occurs from the photosensitive drum 1 to the charging roller 2, rather than from the charging roller 2 to the photosensitive drum 1. As shown in EPO338546 A2, the oscillating voltage has a peak-to-peak voltage (Vpp) which is not less than twice the charge starting voltage $V_{TH}$ when only a DC voltage is applied. By doing so, the reverse charging, that is, the charging from the photosensitive drum 1 to the charging roller 2 occurs. The oscillating voltage is a voltage in which the voltage periodically changes.

By repetition of the charging and the reverse-charging steps, the local non-uniformity of the charging is removed, and with the increase of the distance between the charging roller 2 and the photosensitive drum 1, the oscillating electric field between the charging roller 2 and the photosensitive drum 1 attenuates, so that the charging potential $V_D$ substantially converges to the DC voltage level $V_{DC}$.

Therefore, the peak-to-peak voltage is determined in the manner described above.

The impedance of the charging roller 2 changes due to changes in the ambient conditions. Then, the peak-to-peak voltage of the oscillating voltage required for charging changes. In order to compensate for these changes automatically, the electric current supplied to the charging roller by the oscillating component is controlled to be constant.

The charge potential of the photosensitive drum 1 is determ the level of the DC voltage component. Therefore, it is charged to a constant potential by supplying a constant DC voltage level. Therefore, the DC voltage source of the bias voltage 6 effects the constant voltage control.

The AC source 10 for applying an oscillating voltage between the photosensitive drum 1 and the charging roller 2 comprises an oscillating circuit 11, an upper limiter 12, a voltage raising transformer 13 and a constant current circuit 14.

Figure 2:
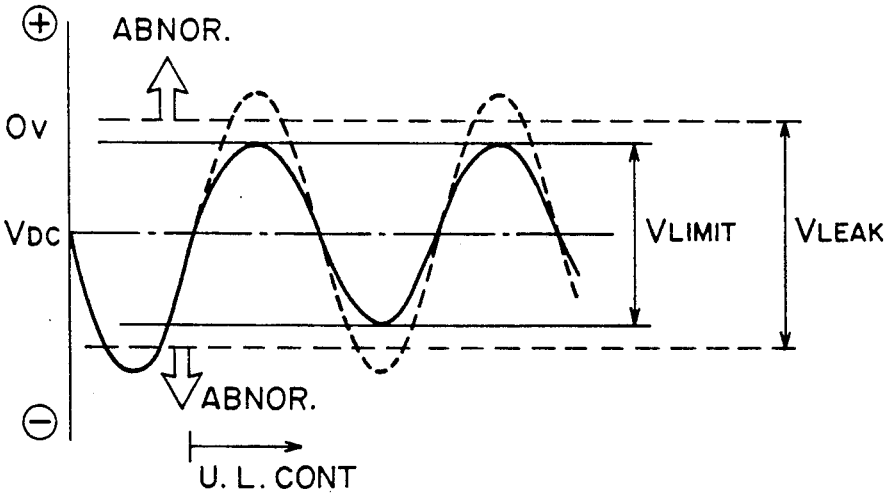
FIGS. 2 and 3 respectfully, show applied bias voltage and charging characteristic in the apparatus of FIG. 1.

FIG. 2 shows the bias voltage applied to the charging roller 2 in this embodiment. When the impedance of the charging roller 2 increases due to change in the ambient conditions, the amplitude of the AC voltage component increases. If it beyond a certain level, an abnormal discharge occurs due to current leakage. The voltage $V_{LEAK}$ is the voltage at which the abnormal discharge due to the leakage occurs. The voltage $V_{LIMIT}$ is the upper limit voltage level and is so selected as to be lower than the abnormal discharge voltage $V_{LEAK}$. The amplitude of the AC voltage is controlled so that a constant current flows through the charging roller 2 (constant current control) within the range below the upper limit voltage $V_{LIMIT}$. When the peak-to-peak voltage Vpp so increases that it will exceed the upper limit, the upper limiter circuit 12 suppresses the peak-to-peak voltage Vpp down to the upper limit voltage $V_{LIMIT}$.

Figure 3:
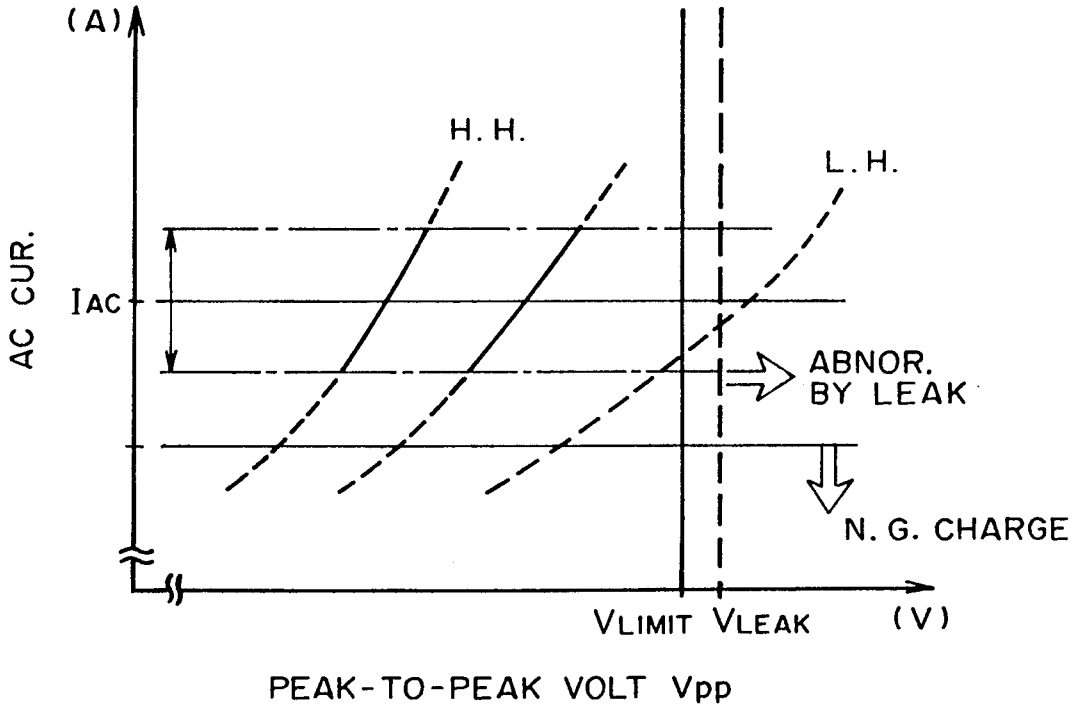

Therefore, when the impedance of the charging roller 2 increases under a low humidity condition, a high peak-to-peak voltage Vpp will result due to the constant current. Thus enter a charging roller 2 having the impedance characteristics which are not usable conventionally as shown in FIG. 3, can be used, because the upper limiter circuit 12 is effective to maintain the peak-to-peak voltage Vpp at the upper limit voltage $V_{LIMIT}$ so that the voltage does not reach the abnormal discharge occurring voltage $V_{LEAK}$.

Figure 4:
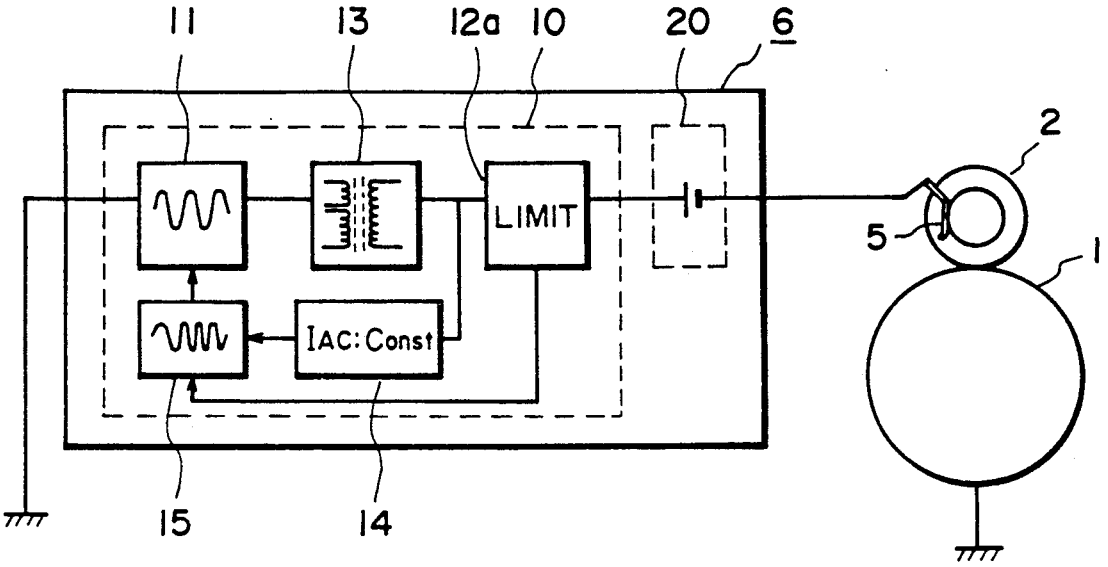
FIGS. 4 and 5 respectfully, show block diagram of a control circuit and an applied bias voltage in a charging device according to a second embodiment of the present invention.

FIG. 4 shows a charging device according to a second embodiment of the present invention, which is usable with an image forming apparatus shown in FIG. 15. In this Figure, the same reference numerals as in the foregoing embodiment are assigned to the elements having the corresponding functions, and the detailed description thereof are omitted for simplicity.

The bias voltage source comprises an AC voltage source 10 and a DC voltage source 20, and applies an oscillating voltage provided by superposing a constant current controlled AC voltage and a constant voltage controlled DC voltage The AC voltage source 10 comprises an oscillating circuit 11, an upper limiter circuit 12*a*, a voltage raising transformer 14, a constant current circuit 14 and a frequency modulating circuit 15.

Figure 5:
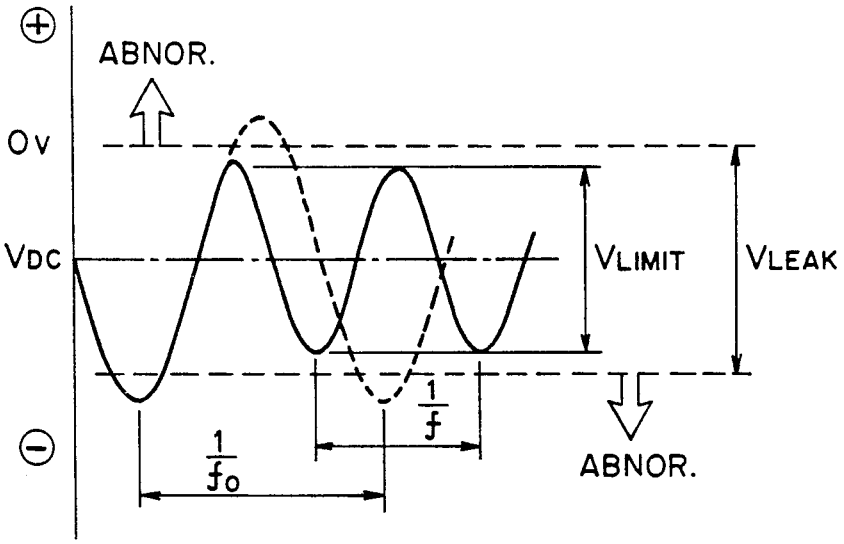

FIG. 5 shows a bias voltage applied to the charging roller 2 by the voltage source 6 in this embodiment.

When the impedance of the charging roller 2 increases due to the ambient condition change to such an extent that the amplitude of the AC voltage exceeds a certain level, the abnormal discharge due to the current leakage occurs. The voltage $V_{LEAK}$ is the voltage level at which the abnormal discharge due to the leakage occurs. The voltage $V_{LIMIT}$ is the upper limit voltage and is so selected that it is lower than the abnormal discharge occurring voltage $V_{LEAK}$. Below the upper limit voltage $V_{LIMIT}$, the amplitude of the AC voltage is controlled with the constant frequency (of) so that the current through the charging roller 2 is constant (constant current control). When the amplitude of the AC voltage exceeds the upper limit voltage $V_{LIMIT}$, the upper limiter circuit 12*a* operates to limit the amplitude to the upper limit voltage $V_{LIMIT}$, and simultaneously, the frequency modulating circuit 15 increases the frequency (f>of) so as to maintain the effective level of the constant AC current.

Therefore, even if the impedance of the charging roller 2 is so increased under a low humidity condition that the peak-to-peak voltage Vpp determined by the constant current control exceeds the upper voltage limit $V_{LIMIT}$, the upper limiter circuit 12*a* and the frequency modulating circuit 15 cooperate to maintain the upper limit voltage $V_{LIMIT}$, and therefore, the voltage does not reach the abnormal discharge occurring voltage $V_{LEAK}$, by which the abnormal discharge due to the leakage can be prevented.

Figure 6:
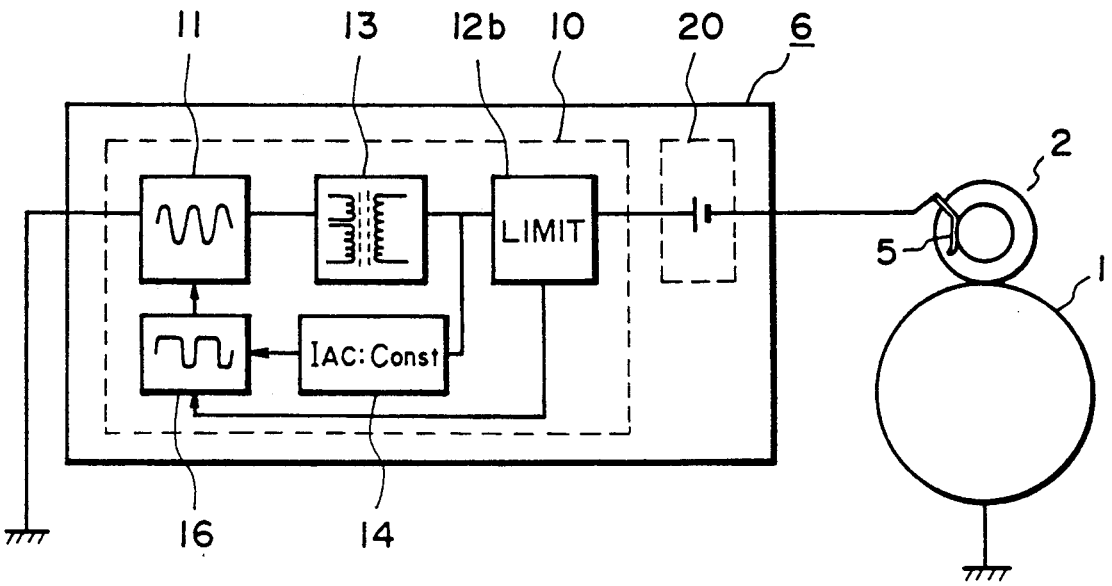
FIGS. 6 and 7 respectuflly, show a block diagram of a control circuit and an applied bias voltage in a charging device according to a third embodiment of the present invention.

FIG. 6 shows a charging device according to a third embodiment of the present invention, which is usable with an image forming apparatus of FIG. 15. In this Figure, the same reference numerals as in the foregoing embodiments are assigned to the elements having the corresponding functions, and detailed descriptions thereof are omitted.

The bias voltage source 6 comprises an AC source 14 and a AC source 20, and supplies to the charging roller 2 an oscillating voltage provided by superposing a constant current controlled AC voltage and a constant voltage controlled DC voltage The AC source 10 comprises an oscillating circuit 11, an upper limiter circuit 12*b*, a voltage raising transformer 13, a constant current circuit 14 and an AC voltage waveform controlling circuit 16.

Figure 7:
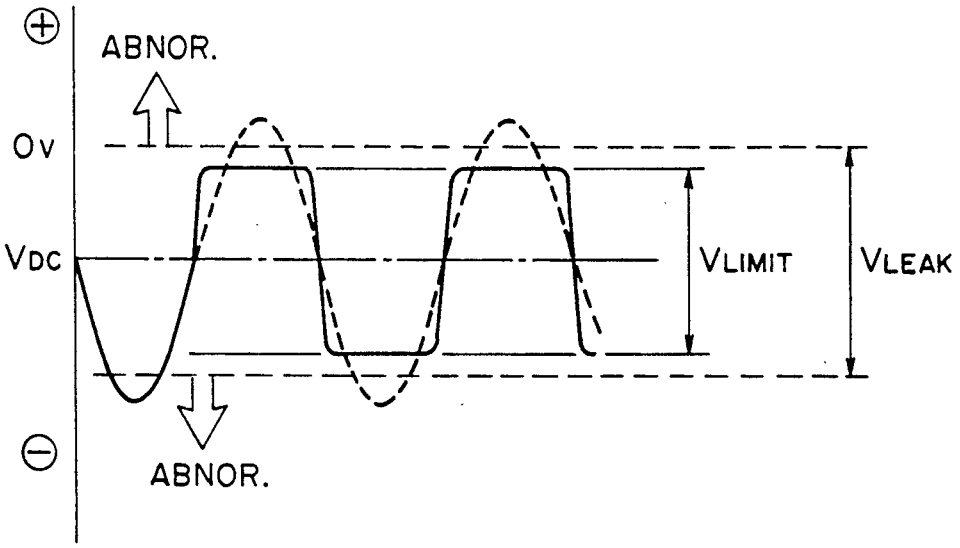

FIG. 7 shows a bias voltage applied to the charging roller 2 from the voltage source 6 in this embodiment.

When the impedance of the charging roller 2 increases due to a charge in the ambient conditions to such an extent that the voltage amplitude of the AC voltage exceeds a certain level, abnormal discharge due to the leakage occurs. The voltage $V_{LEAK}$ is a voltage level at which the abnormal discharge due to the leakage occurs. The voltage $V_{LIMIT}$ is the upper limit and is so selected that it is lower than the abnormal discharge occurring voltage $V_{LEAK}$. Under the upper limit voltage $V_{LIMIT}$, the amplitude of the AC voltage is controlled so that a constant current is supplied to the charging roller 2 (constant current control). When the amplitude of the AC voltage exceeds the upper voltage limit $V_{LIMIT}$, the upper limiter circuit 12*b* functions to maintain the amplitude at the upper voltage $V_{LIMIT}$, and simultaneously, the AC voltage waveform control circuit 16 functions to change the AC voltage waveform to a trapezoidal or rectangular form so as to maintain the effective AC current level.

Therefore, when the impedance of the charging roller 2 increases under a low humidity condition to such an extent that the peak-to-peak voltage Vpp controlled by the constant current control increases so that the amplitude of the AC voltage exceeds the upper limit voltage $V_{LIMIT}$, the upper limiter circuit 12*b* and the AC voltage waveform control circuit 16 cooperate to limit the upper limit voltage $V_{LIMIT}$, and therefore, the abnormal discharge occurring voltage $V_{LEAK}$ is not reached, by which the abnormal discharge due to the leakage can be prevented.

Figure 8:
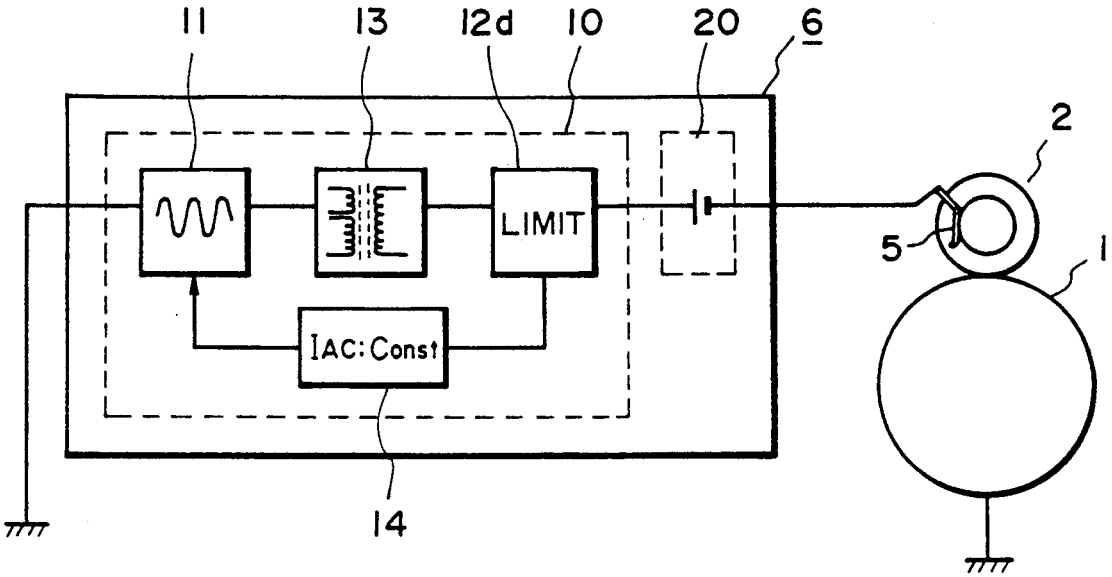
FIGS. 8 and 9 respectfully, show a block diagram and an applied bias voltage in a charging device according to a fourth embodiment of the invention FIGS. 10 and 11 respectfully, show a block diagram of a control circuit and an applied bias voltage in a charging device according to a fifth embodiment of the present invention.

FIG. 8 shows a charging device according to a fourth embodiment of the present invention, which is usable with the image forming apparatus of FIG. 15. In this Figure, the same reference numerals are used for the elements having the corresponding functions as in the above-described embodiments.

According to the experiments and investigations performed by the inventors, even if the peak-to-peak voltage Vpp of the AC voltage is the same, the abnormal discharge due to the leakage tends to occur if the absolute value of the DC voltage component $V_{DC}$ of the bias voltage is large. That is, the abnormal discharge due to the leakage increases with increase of the potential difference between the surface potential of the photosensitive drum 1 and the potential of the charging roller. When the polarity of the DC voltage component $V_{DC}$ of the bias voltage is negative, the abnormal discharge due to the leakage tends to occur when the positive phase of the AC voltage. In consideration of the above, the device of this embodiment is provided with an upper limit only for the voltage in the polarity opposite to that of the DC component voltage.

The bias voltage 6 comprises an AC voltage source 10 and a DC voltage source 20 and applies to the charging roller 2 an oscillating voltage provided by superposing a constant current controlled AC voltage and a constant voltage controlled DC voltage. The AC voltage source 10 comprises an oscillating circuit 11, an upper limiter circuit **12*d*, a voltage raising transformer 13 and a constant current circuit 14**.

Figure 9:
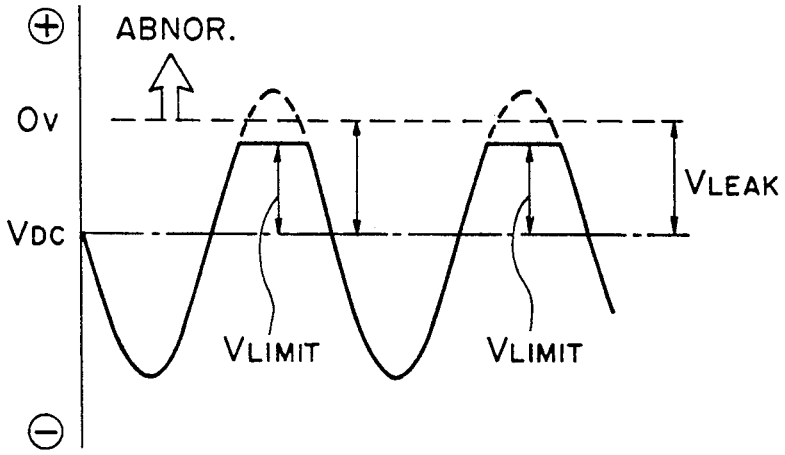

FIG. 9 shows a bias voltage applied to the charging roller 2 from the voltage source 6 in this embodiment.

The DC voltage component $V_{DC}$ of the bias voltage has negative polarity. When the AC voltage is in the negative phase and exceeds a certain level of the voltage, the abnormal discharge due to the leakage occurs. The voltage $V_{LEAK}$ is a voltage level at which the abnormal discharge due to the leakage occurs. The voltage $V_{LIMIT}$ is the upper voltage level, and is so selected as to be smaller than the abnormal discharge occurring voltage $V_{LEAK}$. Under the upper limit voltage $V_{LIMIT}$, amplitude of the AC voltage is controlled so that the constant current flows through the charging roller 2 (constant current control). When the peak-to-peak voltage Vpp so increases that it will exceed the upper limit voltage $V_{LIMIT}$, the amplitude in the positive phase is limited by the upper limiter **12*d***, so that the upper limit voltage $V_{LIMIT}$ is maintained.

Therefore, even if the impedance of the charging roller 2 increases under the low humidity condition to such an extent that the constant current controlled peak-to-peak voltage Vpp increases so that the positive phase amplitude increases, the upper limiter circuit **12*d*** limits the voltage to the upper limit voltage $V_{LIMIT}$, and therefore, the voltage does not reach the abnormal discharge occurring voltage $V_{LEAK}$, and therefore, the abnormal discharge attributable to the current leakage does not occur.

In this embodiment, the upper limit is provided only for the positive phase of the amplitude of the AC voltage, but the same advantageous effects can be provided when the upper limits are provided for both of the phases.

Figure 10:
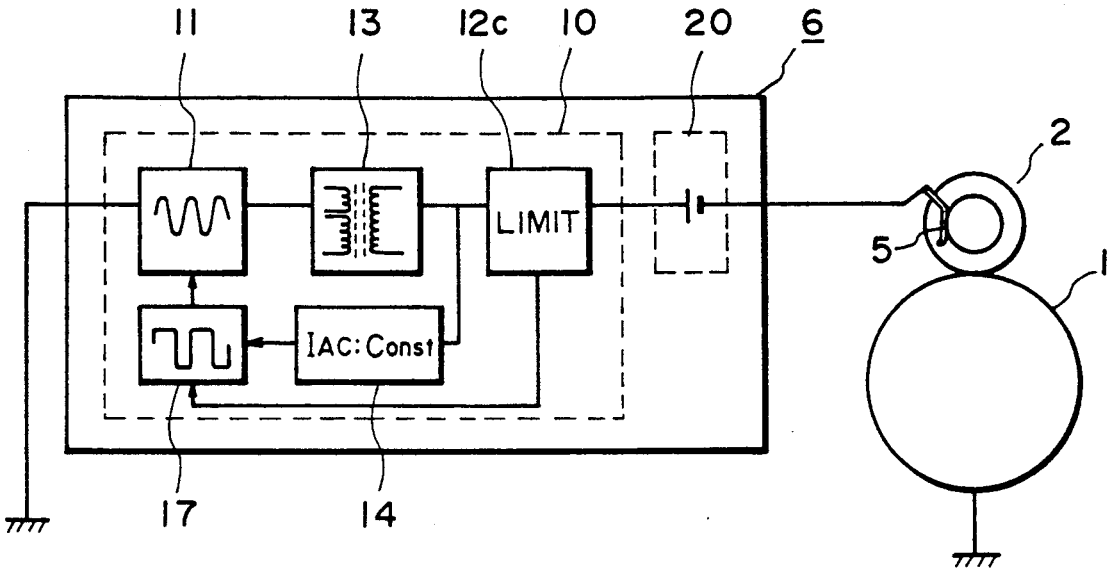
Figure 11:
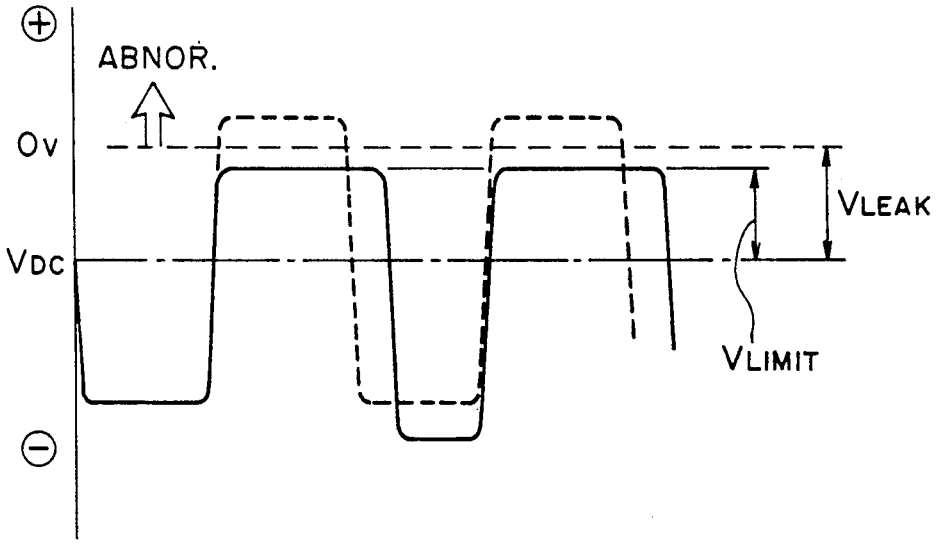
Figure 12:
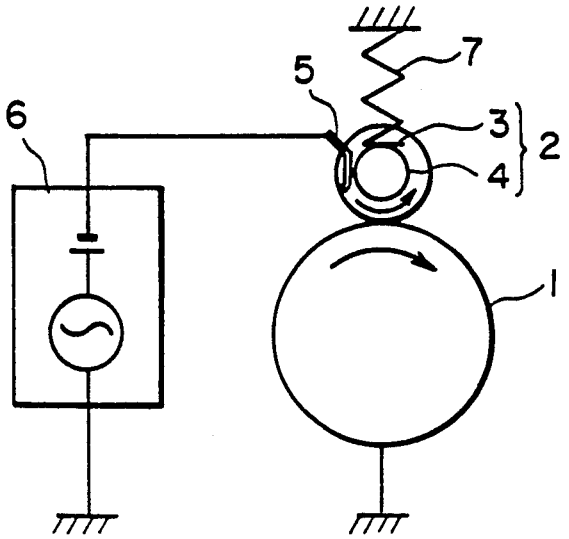
FIG. 12 PRIOR ART
FIG. 12 shows an example of a contact type charging device.

FIG. 10 shows a charging device according to a fifth embodiment of the present invention, which is applicable to an image forming apparatus shown in FIG. 15. In FIG. 10, the same reference numerals as in the foregoing embodiments are assigned to the elements having the corresponding functions, and the detailed descriptions thereof are omitted.

The bias voltage source 6 comprises an AC voltage source 10 and a DC voltage source 20 and applies to the charging roller 2 an oscillating voltage provided by superposing a constant current controlled AC voltage and a constant voltage controlled DC voltage. The AC voltage source 10 comprises an oscillating circuit 11, an upper limiter circuit **12*c*, a voltage raising increasing transformer 13, a constant current circuit 14 and a phase controlling circuit 17**.

FIG. 17 shows a bias voltage applied to the charging roller 2 from the voltage source 6 in this embodiment.

The DC voltage component $V_{DC}$ of the bias voltage has a negative polarity. When the voltage in the positive phase increases a certain level, the abnormal discharge due to the leakage occurs. The voltage $V_{LEAK}$ is the voltage at which the abnormal discharge due to the leakage occurs. The voltage $V_{LIMIT}$ is the upper limit voltage and is so selected as to be lower than the abnormal discharge occurring voltage $V_{LEAK}$. The AC voltage has a rectangular waveform, and the duty ratio is 1:1 below the upper limit voltage $V_{LIMIT}$. The amplitude of the voltage is so controlled that the constant current flows through the charging roller 2 (constant current control). When the amplitude of the AC voltage exceeds the upper limit voltage $V_{LIMIT}$, the upper limiter circuit **12*c* functions to limit the amplitude to the upper limit voltage $V_{LIMIT}$, and simultaneously, the phase control circuit 12** operates to maintain the effective AC current level by increasing the voltage in the phase at which the upper limit voltage $V_{LIMIT}$ is set and increasing the amplitude in the opposite phase corresponding to the resultant reduction.

Therefore, when the impedance of the charging roller 2 increases under a low humidity condition to such an extent that the peak-to-peak voltage Vpp which is controlled by the constant current control so that the amplitude of the AC voltage exceeds the upper voltage limit $V_{LIMIT}$, the upper limiter circuit **12*c* and the phase control circuit 17** functions to limit it to the upper limit voltage $V_{LIMIT}$, and therefore, the abnormal discharge occurring voltage $V_{LEAK}$ is not reached, and therefore, the abnormal discharge due to the leakage does not occur.

In the foregoing embodiments, the charging member is not limited to a roller but may be a blade, rod, pad or the like.

In the foregoing embodiments, the oscillating voltage may be in the form wave, a rectangular wave provided by turning on and off a DC power supply, or the like.

The utility charging device of the present invention is not limited to charging the image bearing member, but it may be used as a contact type transfer charging means for charging a transferable image from an image bearing member to the transfer material by charging a backside of a transfer material introduced between the image bearing member and the transfer member (charging member) supplied with the voltage. It is also usable for charging (or discharging) another member to be charged, such as an insulating member.

As described in the foregoing, according to the present invention, by the provision of the upper limit to the amplitude of the oscillating voltage, the occurrence of a too high voltage can be prevented even if the impedance of the charging member changes due to changes in the ambient conditions. Therefore, the local abnormal discharge due to the leakage of the electric charge once deposited on the member to be charged, can be prevented. When the present invention is used in an image forming apparatus, image quality deterioration due to the leakage can be prevented.

These and other objects, features and advantages of the present invention will become more apparent upon a consideration of the following description of the preferred embodiments of the present invention taken in conjunction with the accompanying drawings.

What is claimed is:

1. A charging device, comprising:

a charging member contactable to a member to be charged;

voltage application means for applying a voltage between said charging member and the member to be charged, said voltage having an oscillating component;

control means for causing the oscillating component to be at a predetermined level; and limiting means for limiting the voltage within a predetermined amplitude.

2. A device according to claim 1, wherein said voltage further comprises a DC component.

3. A device according to claim 2, wherein a voltage of the DC component is constant.

4. A device according to claim 1, further comprising means for controlling a frequency of the oscillating component.

5. A device according to claim 4, wherein said frequency control means causes the oscillating component to be at the predetermined level.

6. A device according to claim 1, further comprising a waveform control means for controlling a waveform of the oscillating component.

7. A device according to claim 6, wherein said waveform control means causes the oscillating component to be at the predetermined level.

8. A device according to claim 1, wherein said limiting means limits a peak level of the voltage in one phase.

9. A device according to claim 1, further comprising duty ratio control means for controlling a duty ratio of the oscillating component.

10. A device according to claim 9, wherein duty ratio control means causes the oscillating component to be at the predetermined level.

11. A device according to claim 1, wherein said charging member is a rotatable member.

12. A device according to claim 1 or 11, wherein said charging member comprises an elastic layer.

13. A device according to claim 1, wherein said limiting means limits the oscillating component within a predetermined range.

14. A device according to claim 1, wherein said limiting means limits both sides of a peak level of the voltage.

15. A device according to claim 1, wherein said control means controls an effective value of the oscillating component.

16. An image forming apparatus, comprising:

an image bearing member;

a charging member contactable to said image bearing member;

voltage applying means for applying a voltage between said image bearing member and said charging member, said voltage having an oscillating component;

control means for causing the oscillating component to be at a predetermined level; and limiting means for limiting an amplitude of said voltage within a predetermined level.

17. An apparatus according to claim 16, further comprising a process unit detachably mountable to said apparatus, wherein said process unit contains said image bearing member and said charging member.

18. An apparatus according to claim 16, wherein an image is formed on said image bearing member, using electric charge on said image bearing member provided by said charging member.

19. An apparatus according to claim 17 or 18, wherein said image bearing member is in the form of a photosensitive member.

* * * * *

UNITED STATES PATENT AND TRADEMARK OFFICE

CERTIFICATE OF CORRECTION

PATENT NO. : 5,305,177

DATED : April 19, 1994

INVENTOR(S) : FUMITAKA AOKI, ET AL.

It is certified that error appears in the above-identified patent and that said Letters Patent is hereby corrected as shown below:

ON TITLE PAGE

In [57] ABSTRACT:
Line 5, "a" (first occurrence) should be deleted.
Line 9, "satisfied." should read --satisfied:--.

COLUMN 1

Line 14, "apparatus, electrode" should read --apparatus, a corona discharger (corona charger) having a wire electrode--.
Line 24, "structure" should read --structure is bulky--.
Line 36, "Therefor" should read --Therefore,--.

COLUMN 2

Line 13, "humidity, resistance" should read --humidity conditions, the resistance--.
Line 22, "Publication 0 338 546 A3." should read --Publication 0338546 A2.--.
Line 63, "apparatus" should read --apparatus using--.

COLUMN 4

Line 15, "de 4" should read --device 4--.

COLUMN 5

Line 7, "determ" should read --determined by--.
Line 21, "it" should read --it is--.
Line 38, "Thus enter" should read --Thus, even--.

--

UNITED STATES PATENT AND TRADEMARK OFFICE

CERTIFICATE OF CORRECTION

PATENT NO. : 5,305,177

DATED : April 19, 1994

INVENTOR(S) : FUMITAKA AOKI, ET AL.

It is certified that error appears in the above-identified patent and that said Letters Patent is hereby corrected as shown below:

COLUMN 6

Line 4, "(of)" should read --(f0)--.
Line 11, "(f>of)" should read --(f-f0)--.

Signed and Sealed this

Thirteenth Day of December, 1994

Bruce Lehman

*Attest:*

BRUCE LEHMAN

*Attesting Officer*

*Commissioner of Patents and Trademarks*

--